US006135369A

United States Patent [19]

Prendergast et al.

[11] Patent Number: 6,135,369

[45] **Date of Patent: *Oct. 24, 2000**

[54] ELECTROSTATIC SPRAYING

[75] Inventors: Maurice Joseph Prendergast, Runcorn; Timothy James Noakes, Clwyd, both of United Kingdom

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/125,981

[22] PCT Filed: Feb. 12, 1997

[86] PCT No.: PCT/GB97/00376

§ 371 Date: Nov. 6, 1998

§ 102(e) Date: Nov. 6, 1998

[87] PCT Pub. No.: WO97/31718

PCT Pub. Date: Sep. 4, 1997

[30] Foreign Application Priority Data

Feb. 29, 1996 [GB] United Kingdom ..... 9604329

[51] Int. Cl.[7] ..... B05B 5/16

[52] U.S. Cl. ..... 239/690

[58] Field of Search ..... 239/3, 690, 34, 239/706

[56] References Cited

U.S. PATENT DOCUMENTS

| | | | |
|---|---|---|---|
| 3,653,593 | 4/1972 | Watanabe | 239/15 |
| 4,290,091 | 9/1981 | Malcolm | 239/690 |
| 4,331,298 | 5/1982 | Bentley et al. | 239/690 |
| 4,356,528 | 10/1982 | Coffee | 361/226 |
| 4,549,243 | 10/1985 | Owen et al. | 239/690 |
| 4,561,037 | 12/1985 | MacLaine et al. | 361/228 |
| 4,663,639 | 5/1987 | Owen et al. | 346/140 |
| 5,121,884 | 6/1992 | Noakes | 239/691 |
| 5,184,778 | 2/1993 | Noakes | 239/691 |
| 5,196,171 | 3/1993 | Peltier | 239/706 |
| 5,221,050 | 6/1993 | Jeffries et al. | 239/708 |
| 5,222,663 | 6/1993 | Noakes et al. | 239/3 |
| 5,222,664 | 6/1993 | Noakes et al. | 239/3 |
| 5,292,067 | 3/1994 | Jeffries et al. | 239/3 |
| 5,337,963 | 8/1994 | Noakes | 239/690 |
| 5,382,410 | 1/1995 | Peltier | 422/120 |
| 5,490,633 | 2/1996 | Jeffries et al. | 239/691 |
| 5,503,335 | 4/1996 | Noakes et al. | 239/690 |
| 5,511,726 | 4/1996 | Greenspan et al. | 239/690 |
| 5,684,666 | 11/1997 | Naokes et al. | 361/228 |
| 5,810,265 | 9/1998 | Cornelius et al. | 239/690 |
| 5,927,618 | 7/1999 | Jeffries et al. | 239/690.1 |

FOREIGN PATENT DOCUMENTS

| | | |
|---|---|---|
| WO 95/06521 | 3/1995 | WIPO . |
| WO 95/29758 | 11/1995 | WIPO . |
| WO 96/10459 | 4/1996 | WIPO . |

*Primary Examiner*—Kevin Shaver
*Assistant Examiner*—David Deal
*Attorney, Agent, or Firm*—Leonard W. Lewis; T. David Reed

[57] ABSTRACT

An electrostatic spraying device comprising a high voltage generating circuit powered by a low voltage circuit comprising one or more radiation sensitive elements and charge storage means.

16 Claims, 3 Drawing Sheets

ELECTROSTATIC SPRAYING

This invention relates to electrostatic spraying.

The invention has particular application to electrostatic spraying devices for use in applications involving for example air freshening, air purification, insecticide spraying, personal care/hygiene products (eg deodorants, cosmetics and perfumes) and medical and quasi-medical products such as nasal and respiratory tract sprays.

Examples of devices suitable for such applications are disclosed in our prior EP-A-120633, 441501, 468735, 468736, 482814, 486198, 501725, 503766 and 607182, PCT-A-WO94/13063 and International Patent Application No. PCT/GB94/01829, PCT/GB95/00915, PCT/GB95/02218, the entire disclosures of which are incorporated herein by this reference.

Such devices invariably incorporate a high voltage generator for producing a voltage in the kilovolt range for application to the material to be sprayed. The voltage generator is powered by a low voltage power source which, in the prior art, comprises one or more disposable batteries.

The present invention seeks to simplify the low voltage power source with the aim of avoiding the need for battery replacement (which is environmentally undesirable). The invention may also permit a reduction in overall size of the device especially in circumstances where size is of significance.

According to the present invention there is provided an electrostatic spraying device comprising a housing for accommodation of a supply of material suitable for electrostatic spraying, an outlet from which the material is projected and high voltage generating means for applying high voltage to the material, characterised in that the generating means includes a low voltage power source in the form of one or more elements capable of producing electrical current in response to irradiation and a charge storage means for storing electrical charge produced by said element(s).

Preferably the charge storage means comprises one or more capacitors.

Alternatively the charge storage means may comprise one or more batteries of the rechargeable type.

Preferably the device is of the type in which the high voltage is applied to the material to be sprayed prior to issue of the material from the outlet.

Typically the high voltage generating means produces a voltage output of up to 35 kV, e.g. from 3 to 35 kV, more usually in the range 3 to 20 kV, with 5 to 20 kV being preferred.

The low voltage source will typically produce an output voltage which is typically at least two orders of magnitude less than the high voltage output of the generating means, e.g. in the range 1.5 to 24 volts.

Said element(s) will be so located on the device as to be exposed to ambient light. The element(s) will normally be permanently exposed but the arrangement may be such that the element(s) can be selectively masked or otherwise concealed from the ambient light until such time as the device is to be used, although in the latter case it may be necessary to allow the low power source to generate sufficient power by exposure of said element(s) to ambient light before spraying can be initiated.

The device is suitably dimensioned for handheld use when used for application of sprayed material to the person. Where the device is to be used to spray material into a room for air fragrancing, air purification and the like, it is preferably so dimensioned as to be portable using one hand only.

The location of said element(s) is selected with regard to the manner in which the device is to be used. Where for instance the device is to be used for emitting a liquid spray into the atmosphere, for instance for the purposes of fragrancing and/or purifying the air, the device will normally be designed to be placed on a horizontal surface such as a window sill. In this event, the location of the element(s) will be such as to ensure that adequate light falls onto the element(s) irrespective the orientation of the device when stood on a horizontal surface. Where the device is intended to be held in the hand while spraying (eg spraying of personal care/hygiene products), the location of the element (s) may be such that they are not concealed by the hand in normal handling of the device while spraying—however this is not essential since the charging will generally take place while the device is not in spraying use.

The element(s) may be located on an external surface of the device or within the body of the device but exposed to ambient light through a window section provided in the device housing.

Usually there will be an array of said elements and the array (or a single element if used) preferably has a radiation sensitive areal extent of no more than 5 $cm^2$ (often no more than 3 $cm^2$ and in some cases no more 2.5 $cm^2$) per kV of high voltage output produced by the voltage generating means when the device is operational and producing an electrostatically charged spray of material.

A device according to the invention is particularly suitable for applications in which the spraying operation need only be sustained for a relatively short period of time on each occasion the device is used or required to come into operation and in which the power output (operating voltage multiplied by output current) delivered by the voltage generating means during spraying is less than 5 mW, typically less than 2 mW and more usually less than 1 mW. This is typically the case for devices which are used for air fragrancing for example in that the spraying may take place at regular intervals for a short period of time. The device is also suitable for applications in which use is relatively infrequent (such as perfume and medical and quasi-medical sprays) and in this instance the power output of the device may be somewhat greater, eg up to 20 mW.

Devices in accordance with the invention typically have a time averaged power consumption of no more than 500 mW/hr.

The duty cycle of the device will depend on the radiation sensitive areal extent of said element(s) and also the capacity of the charge storage means of the low voltage power source. Typically the arrangement is such that, when said element(s) is/are exposed to ambient light at a level of 1.0 $kW/m^2$ (equivalent to full sunlight), the duty cycle of the device is at least 5%, preferably at least 10% and more preferably at least 30%. However, for some applications, the duty cycle may be less than 5%, eg for perfume and medical applications, where frequency of use may be relatively low.

As used herein "duty cycle" refers to the ratio, expressed as a percentage, of the time interval during which spraying can be sustained to the time needed to replenish the charge storage means of the low voltage power source sufficiently to permit a further spraying interval of the same duration.

In some applications, the duty cycle may be variable under the control of the user. For instance, in room fragrancing applications, periodic bursts of spray rather than a continuously sustained spray are desirable to avoid olfactory "fatigue". Provision of means for user selection of the duty cycle allows the user to adjust the periodicity of the bursts of fragrance to his/her preference. Such means may for instance comprise a masking arrangement such as a cover which is movable to vary the extent of exposure of said element(s).

The radiation sensitive element(s) may be fabricated from an amorphous or polycrystalline photovoltaic material, preferably the polycrystalline variety since this tends to have a higher light/power conversion efficiency. Such materials are widely available and are commonly used for instance in solar powered electronic devices such as electronic hand held calculators.

Preferably the low voltage power source includes means for controlling current supply from the charge storage means to the high voltage generating means in such a way that current supply to the voltage generating means cannot commence until the amount of charge stored by the charge storage means reaches a predetermined upper threshold and current supply is terminated when the charge stored falls to a lower predetermined threshold and cannot resume until said upper threshold is once again attained as a result of radiation-induced charge replenishment.

This form of control has been found to be particularly suitable for use with voltage generating means of the type requiring a higher transient start-up current to trigger initiate operation than the maintenance current required to operate the voltage generating means during its steady state mode of operation. This applies for example to voltage generating means of the type disclosed in our prior European Patent Application No. 441501, ie a voltage generating means of the type comprising means for converting low voltage from a dc supply into a relatively low ac voltage, means for storing the energy content of said ac voltage, means for repeatedly discharging the energy-storing means to produce a relatively low magnitude higher frequency decaying oscillatory voltage, high gain transformer means for converting said higher frequency voltage to a large magnitude decaying oscillatory voltage (typically at least 5 kV), and means for rectifying said large magnitude voltage to provide a unipolar high voltage output.

For at least some applications, eg personal care product sprays such as deodorants, cosmetics etc. and medical and quasi-medical product sprays, preferably the device includes standby means for signalling to the user whether or not the device is ready for use. The signal may take any suitable form including audible and tactile but will usually be of a visual nature. For instance, when sufficient charge is stored in the low voltage power source to permit spraying to commence, a low current consumption signal source, such as a liquid crystal display, provided on the device may signify readiness for operation. In another embodiment, the visual signal may be produced by means of a change of colour in a resistive dye to which current from the charge storage device(s) is supplied.

Operation of the voltage generating means and hence initiation of spraying will usually be controlled by means of a user-actuable switch of some form. The switch may be a simple mechanical switch, an electronic switch (eg field effect transistor) or an optical switch for instance involving interruption of a light beam by blocking a hole through which light passes by means of a finger or other part of the hand.

Where the standby means is provided, it may be effective to override the user-actuable switch, ie so that operation of the user-actuable switch is only effective if the lower voltage power supply is in a state of readiness.

Some form of timing arrangement may be provided to limit or otherwise control the length of time that the device can be operational on any one occasion.

The device may include means for signalling the impending cessation of spraying as a result of charge depletion in the charge storage means. Thus, such signalling means may be arranged to monitor the level of charge storage in said charge storage device(s) and produce an output indicating that cessation can be expected within a predetermined time interval and/or providing a countdown facility.

Where the spraying device incorporates both means for indicating readiness for operation and means for indicating impending cessation of spraying, the signalling device may be common to both functions. For instance, readiness for spraying may be indicated by a low current consumption device such as a liquid crystal device which once a state of readiness has been attained produces a signal to indicate that the device is in a condition for spraying and subsequently produces an output indicating that cessation of spraying is imminent (eg by way of display indicating the time remaining until cessation of spraying can be expected).

The material to be sprayed may be a liquid formulation (possibly with solids suspended therein) or it may be a powder. Where the material to be sprayed comprises a liquid formulation, it may be passively or positively fed to the nozzle from which it is projected during the spraying operation. Various forms of passive and positive feed of liquid to a spraying nozzle are disclosed in the prior patents referred to previously. Where the material to be sprayed comprises a powder, the device may be generally in the form shown in our prior PCT/GB95/02218 the entire disclosure of which is incorporated herein.

The invention will now be described by way of example only with reference to the accompanying drawings, in which.

Figure 1:
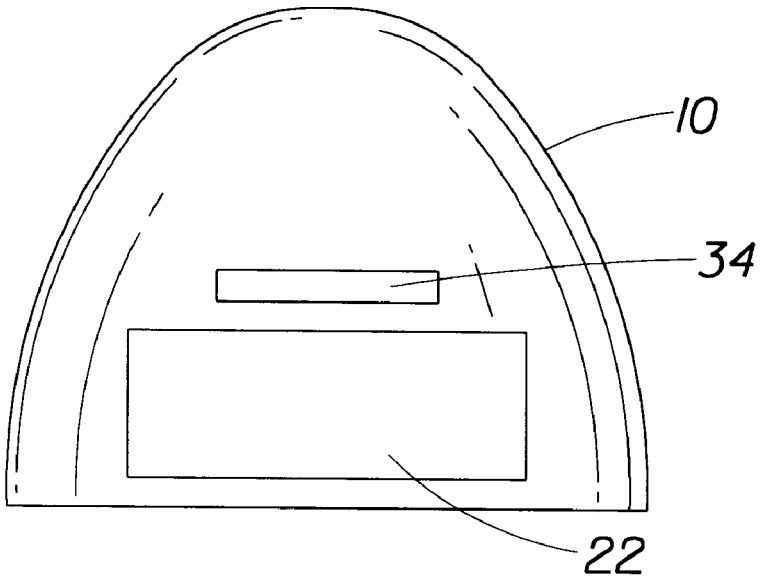
FIG. 1 is an external schematic view of an air fragrancing, air purifying and/or insecticide spraying device in accordance with the invention.
Figure 2:
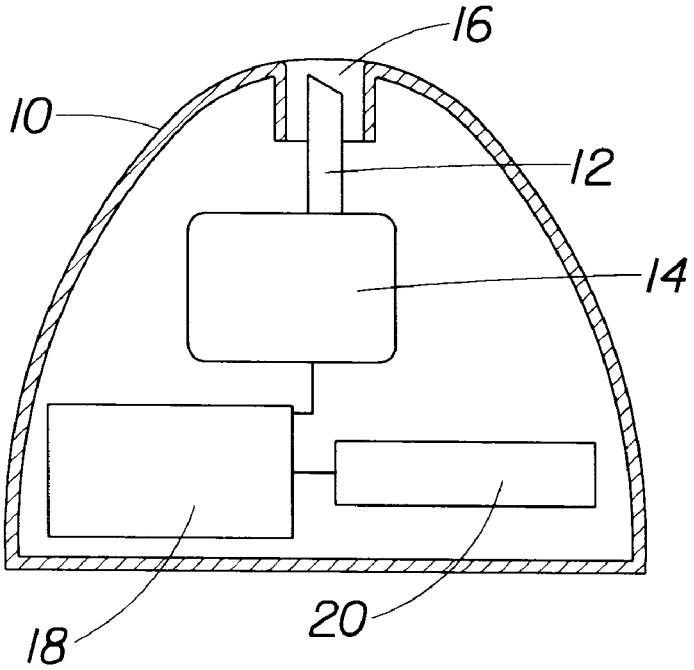
FIG. 2 is a schematic circuit diagram showing the internal layout of the device in FIG. 1.

Referring to FIGS. 1 and 2, the electrostatic spraying device shown diagrammatically may be of the form disclosed in our prior EP-A-486198, EP-A-607182 or WO-A-95/06521, the entire disclosures of which are incorporated herein by this reference. The device comprises a housing 10 with a dispensing outlet 12 from which the material to be sprayed is discharged. The material to be sprayed may be in the form of a formulation including a fragrant oil or oils and/or it may comprise a formulation suitable for effecting purification of the air, eg a formulation which in spray form serves to trap air-borne agents such as particles of dust. In the illustrated embodiment, the dispensing outlet is in the form of a capillary tube which is inserted into a reservoir 14 containing the formulation to be sprayed. The reservoir 14 and capillary tube 12 may be of the form described in International patent Application No. WO 95/06521 or EP-A-486198 and are conveniently embodied in a replaceable cartridge, the housing 10 being suitably designed to allow removal of the cartridge for replacement purposes. The upper end of the tube 12 registers with an opening 16 in the housing 10 for discharge of the formulation as a fine spray of droplets in the manner described in International Patent Application No. WO 95/06521 or EP-A-486198. The tube 12 in the illustrated embodiment is shown as having its spraying tip within the confines of the housing 10; in an alternative arrangement, it may project through the opening 16 and beyond the housing 10.

High voltage is applied to the formulation prior to its discharge from the capillary tube by means of high voltage generator 18, the output of which is applied to the body of liquid in the reservoir or liquid within the tube 12 in any suitable manner, e.g. as described in International Patent Application No. WO 95/06521 or EP-A-486198. This generator 18 is powered by a low voltage circuit 20 which comprises charge storage means in the form of one or more capacitors or rechargeable batteries to which charge is supplied from an array 22 of photocells mounted on the device in such a way as to be exposed (or at least selectively exposed) to ambient light. In FIG. 1, the array 22 is shown as being mounted on an external surface of the device so as to be permanently exposed to ambient light. However, it will be understood that the array may for example be located internally of the housing and exposed to ambient light through an opening or window formed in the housing 10 and exposure may be selective or permanent. In the case of selective exposure, the device may be provided with some form of masking arrangement movable between positions in which the array is fully exposed to ambient light and partially or fully masked from ambient light, for instance under the control of the user. A switch (not shown) may be associated with the device to control operation of the high voltage generator—e.g. the switch may form part of the low voltage source and will be located for access by the user.

It will be understood that normal spraying operation of the device is possible when the charge storage means has sufficient charge stored to support operation of the voltage generator 18. However, in practice, the spraying operation will need to be sustained sufficiently long to produce the desired effect, especially in the case of an air fragrancing and/or purifying device. The level of charge storage built up in the charge storage means will therefore need to be sufficient to allow operation of the device for the desired time interval. Moreover, once a spraying operation has been carried out, sufficient time may be needed to replenish the charge storage means before a further cycle of operation is possible. A suitable arrangement meeting these requirements will now be described with reference to FIG. 3.

Figure 3:
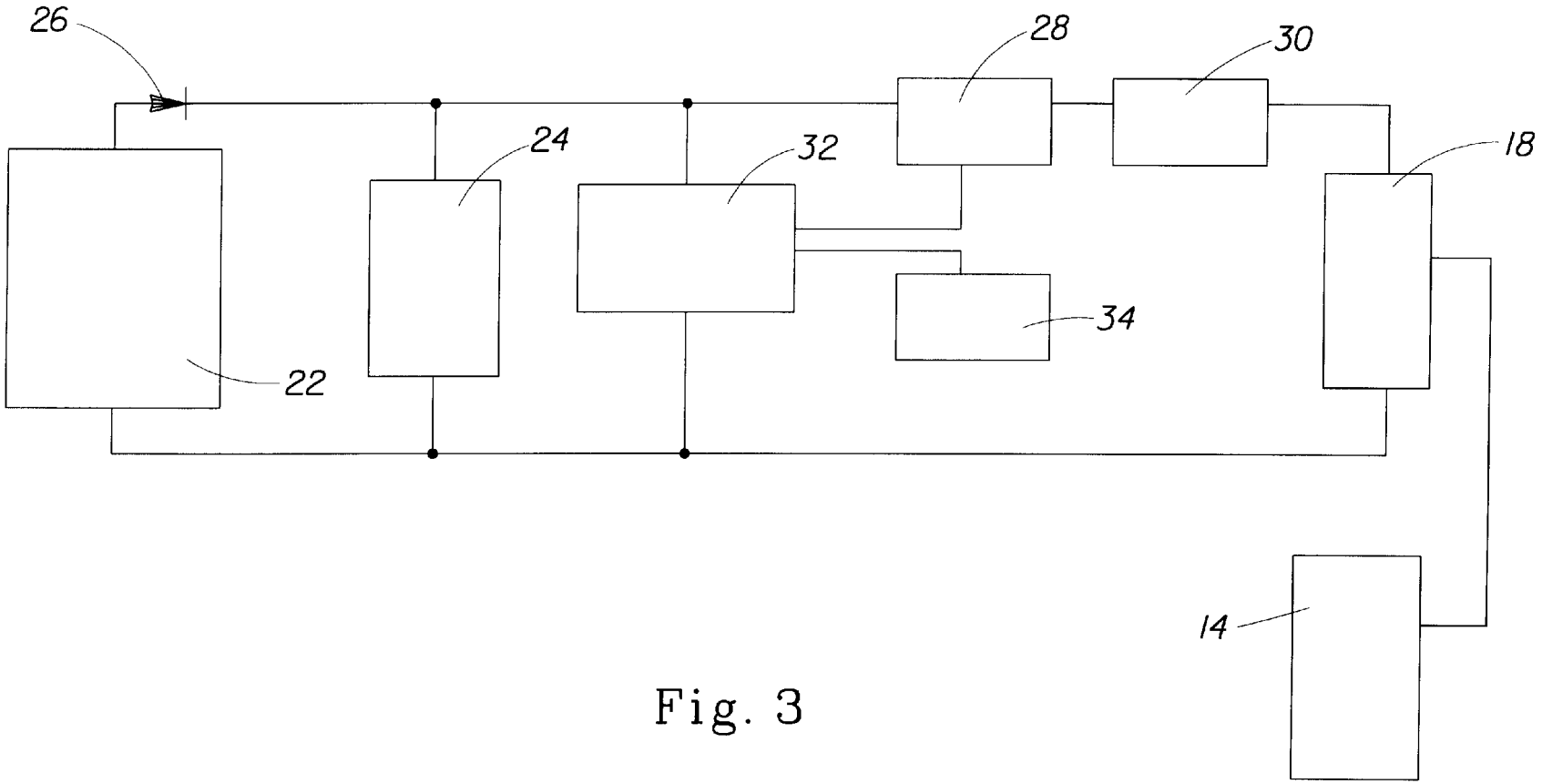
FIG. 3 is a diagrammatic low power voltage circuit suitable for use in the device in FIGS. 1 and 2.

The low voltage circuit of FIG. 3 comprises the array 22 which is connected to the charge storage device 24 via diode 26. The array 22 typically comprises a number of light sensitive elements fabricated from an amorphous or polycrystalline photovoltaic material, the number of elements in the array being such that the charge supplied to the charge storage device 24 is sufficient to develop the power needed to operate the high voltage generator in a manner consistent with the spraying requirements of the device. The charge storage device 24 is connected via switches 28 and 30 to the voltage generator 18, the output of which is connected to the reservoir 14. Switch 30 is a user operable switch and may be optional in the case of an air fragrancing or purifying device. Switch 28 is controlled by a voltage sensing circuit 32 which senses the level of charge stored by the charge storage means by sensing the voltage across the latter. The switch 28 is desirably one having very low current leakage properties, e.g. a field effect transistor.

Once a suitable level of charge storage is sensed by sensor 32 (and assuming that the user has operated switch 30 to allow the device to operate), switch 28 is actuated to connect the charge storage means 24 to the input of the generator 18 and is maintained in its operative condition until the voltage level sensed by sensor 32 falls below a predetermined level at which time switch 28 disconnects the generator 18 from the charge storage means 24 and thereby deactivates spraying.

Typically the sensor 32 will trigger operation of the switch 28 when the level of charge stored reaches a predetermined upper threshold (e.g. about 12 volts) and spraying operations can then be effected until the charge level falls below a predetermined lower threshold (e.g. about 8 volts). Further spraying operations are then prevented to allow recharging of the charge storage means until the level of charge stored again reaches the upper threshold. In this way, a cycle of operation is obtained giving "on" and "off" periods and these may be tailored as desired. For instance, in the case of air fragrancing, the relative proportion of "on" and "off" times may be selected so as to avoid olfactory fatigue. Where the array 22 is provided with some form of adjustable masking arrangement, the user may adjust the cycle by adjusting the degree of masking and hence the rate of charge replenishment to the charge storage means 24. If desired, timing means may be provided to allow the "on" and "off" times to be preset and/or adjusted; for instance, the voltage sensing circuit 32 may incorporate a timer by means of which the "on" part of the spraying cycle is determined so that spraying is terminated once the timer has timed out but can be resumed after a preset "off" interval allowing the charge to be replenished sufficiently for a further operation for a preset "on" interval. The timer may be preset or it may be adjustable by the user according to requirements.

Associated with the sensor 32 is a signalling device 34, conveniently a visual display mounted on the housing, which is intended to provide the user with information concerning the condition of the charge storage means 24 and thereby provide an indication as to whether the device is sufficiently charged for spraying to commence in response to closure of the switch 30.

The switch 28 may be maintained operative for a time interval sufficient to maintain spraying without necessarily depleting the charge storage means to the point where it can no longer sustain spraying. The signalling device will normally be powered by the charge storage means 24 and should therefore have a very lower power consumption, e.g. a liquid crystal display device.

Figure 4:
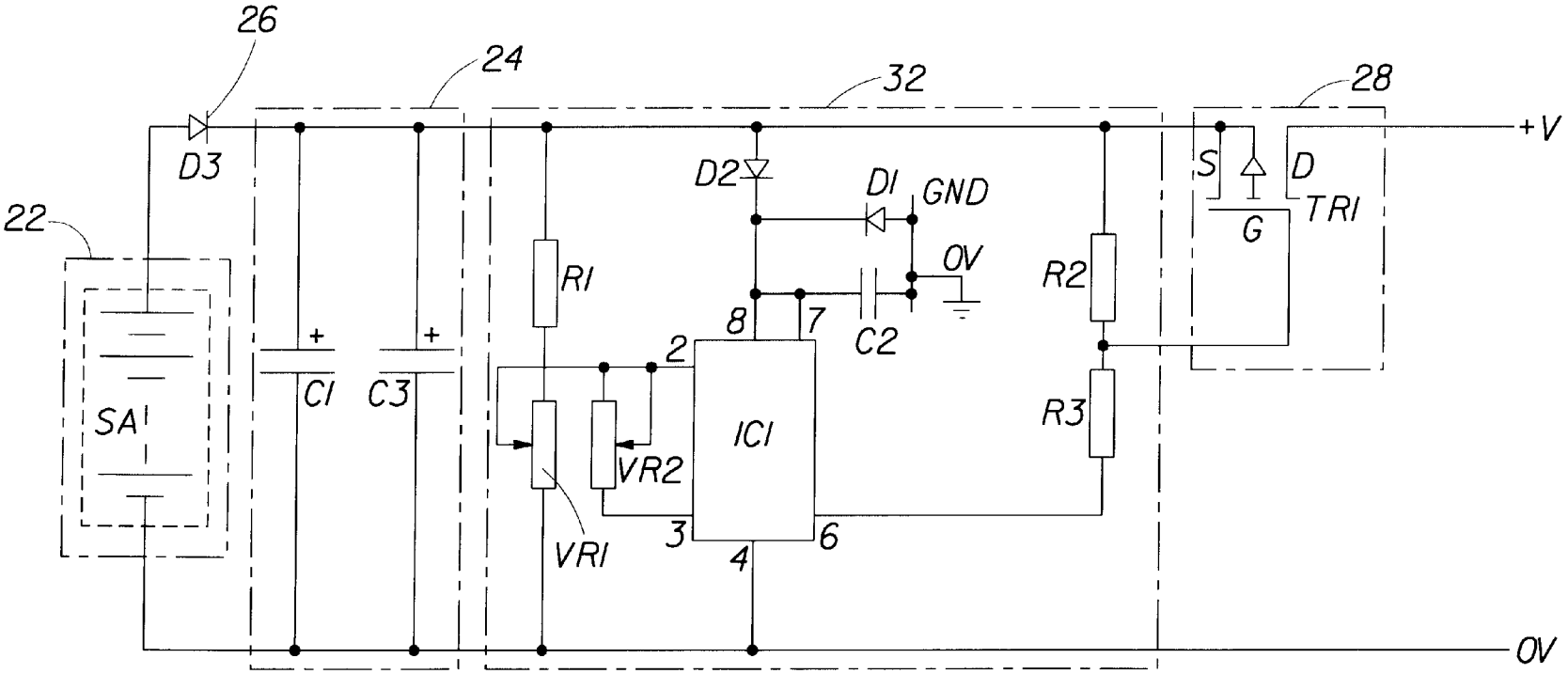
FIG. 4 is a circuit diagram showing the practical implementation of certain components illustrated in block diagrammatic form in FIG. 3.

FIG. 4 illustrates typical circuit components that may be used in the implementation of certain elements of the circuit shown in FIG. 3, in particular the elements 24, 28 and 32. The circuit components employed in the FIG. 4 are as follows:

| | |
|---|---|
| SA | Solar array fabricated from 8 arrays connected serially, taken from Canon LS-24H Electronic calculator (RS 819-589) |
| R1, R2 and R3 | 1 Mohm, 0.25 W metal film resistor (RS149-228) |
| VR1 | 500 Kohm, 0.5 W, 10 turn potentiometer (RS160-146) |
| VR2 | 1 Mohm, 0.5 W, 10 turn potentiometer (RS160-152) |
| C1 | 220 uF, 25 V electrolytic capacitor (RS107-038) |
| C2 | 0.1 uF, 63 V ceramic capacitor (RS126-556) |
| C3 | 2200 uF, 25 V electrolytic capacitor (RS107-066) |
| D1 | 14 V, 500 mW Zener diode (RS 183-8250) |
| D2 | Signal diode (RS 109-258) |
| D3 | Signal diode BAT 85 (RS 300-978) |
| IC1 | MAX 700 CPA Power supply monitor (RS 297-535) |
| TR1 | ZVP2106A FET transistor (RS 655-565) |

The above components as identified by their RS catalogue numbers are available from RS Components Ltd, PO Box 99, Corby, Northants, NN17 9RS, England.

We claim:

1. An electrostatic spraying device comprising a housing for accommodation of a supply of material suitable for electrostatic spraying, an outlet from which the material is projected and high voltage generating means for applying high voltage to the material, characterised in that the generating means includes a low voltage power source in the form of one or more elements capable of producing electrical current in response to irradiation and a charge storage means for storing electrical charge produced by said element (s).

2. A device as claimed in claim 1 in which the charge storage means comprises one or more capacitors.

3. A device as claimed in claim 1 in which the charge storage means comprises one or more batteries.

4. A device as claimed in claim 1 of the type in which the high voltage is applied to the material to be sprayed prior to issue of the material from the outlet.

5. A device as claimed in claim 1 in which an output voltage produced by the low voltage source is at least two orders of magnitude less than the high voltage output of the generating means.

6. A device as claimed in claim 1 including means for selectively masking said element(s).

7. A device as claimed in claim 1 including signalling means for indicating whether the state of said charge storage means will support a spraying operation.

8. A device as claimed in claim 1 in which said element(s) are so located on the device as to be exposed to ambient light.

9. A device as claimed in any one of the preceding claims in which an array of said elements is provided.

10. A device as claimed in claim 1 in which the total radiation sensitive areal extent of said element(s) is no more than 5 $cm^2$ per kV of high voltage output produced by the voltage generating means when the device is operational and producing an electrostatically charged spray of material.

11. A device as claimed in claim 10 in which the total radiation sensitive areal extent of said element(s) is no more than 3 $cm^2$ per kV of high voltage output produced by the voltage generating means when the device is operational and producing an electrostatically charged spray of material.

12. A device as claimed in claim 1 in which means is provided controlling current supply from the charge storage means to the high voltage generating means in such a way that current supply to the voltage generating means cannot commence until the amount of charge stored by the charge storage means reaches a predetermined upper threshold and current supply is terminated when the charge stored falls to a lower predetermined threshold and cannot resume until said upper threshold is once again attained.

13. A device as claimed in claim 1 including means for signalling the impending cessation of spraying as a result of charge depletion in the charge storage means.

14. A device as claimed in claim 13 in which charge depletion signalling means is arranged to monitor the level of charge storage in said charge storage means and produce an output indicating that cessation can be expected within a predetermined time interval and/or providing a countdown facility.

15. A device as claimed in claim 1 in which the high voltage generating means comprises means for converting low voltage from a dc supply into a relatively low ac voltage, means for storing the energy content of said ac voltage, means for repeatedly discharging the energy-storing means to produce a relatively low magnitude higher frequency decaying oscillatory voltage, high gain transformer means for converting said higher frequency voltage to a large magnitude decaying oscillatory voltage, and means for rectifying said large magnitude voltage to provide a unipolar high voltage output.

16. A device as claimed in claim 1 including a timing means for controlling the length of time that the device can be operational for spraying purposes on any one occasion.

* * * * *